US008950114B1

(12) United States Patent
Groening

(10) Patent No.: US 8,950,114 B1
(45) Date of Patent: Feb. 10, 2015

(54) HANDS-FREE GUN-PORT DOOR WITH SEAL

(71) Applicant: Greg Groening, Salisbury, NC (US)

(72) Inventor: Greg Groening, Salisbury, NC (US)

(73) Assignee: Kontek Industries, Inc, Kannapolis, NC (US)

( * ) Notice: Subject to any disclaimer, the term of this patent is extended or adjusted under 35 U.S.C. 154(b) by 0 days.

(21) Appl. No.: 13/899,448

(22) Filed: May 21, 2013

Related U.S. Application Data

(60) Provisional application No. 61/655,683, filed on Jun. 5, 2012.

(51) Int. Cl.
*F41H 5/26* (2006.01)

(52) U.S. Cl.
CPC ..... *F41H 5/26* (2013.01)
USPC ..... 49/171; 52/207; 89/36.14

(58) Field of Classification Search
USPC ..... 52/207, 204.5, 243.1, 64; 49/169, 171; 89/36.14, 36.04
See application file for complete search history.

(56) References Cited

U.S. PATENT DOCUMENTS

| | | | | | |
|---|---|---|---|---|---|
| 1,827,299 | A | * | 10/1931 | Pritchard | 296/152 |
| 2,055,339 | A | * | 9/1936 | Dalton | 220/4.01 |
| 2,763,900 | A | * | 9/1956 | McAfee et al. | 49/70 |
| 2,927,788 | A | * | 3/1960 | Slopa et al. | 49/27 |
| 3,204,999 | A | * | 9/1965 | Schwenk | 49/213 |
| 3,262,227 | A | | 7/1966 | Pentecost | |
| 3,727,349 | A | * | 4/1973 | Bainbridge | 49/411 |
| 4,085,966 | A | * | 4/1978 | Ringe | 296/146.5 |
| 4,662,110 | A | * | 5/1987 | Rokicki | 49/220 |
| 4,731,950 | A | * | 3/1988 | Ullner | 49/221 |
| 4,771,672 | A | | 9/1988 | Miller | |
| 4,771,673 | A | | 9/1988 | Miller | |
| 4,810,025 | A | * | 3/1989 | Riley | 296/146.1 |
| 5,305,969 | A | * | 4/1994 | Odell et al. | 244/129.5 |
| 5,473,840 | A | * | 12/1995 | Gillen et al. | 49/380 |
| 5,505,023 | A | * | 4/1996 | Gillen et al. | 49/380 |
| 5,908,228 | A | * | 6/1999 | Lee | 312/405 |
| 6,425,311 | B1 | | 7/2002 | Caron | |
| 6,477,806 | B1 | * | 11/2002 | Asada et al. | 49/169 |

(Continued)

FOREIGN PATENT DOCUMENTS

| | | | | |
|---|---|---|---|---|
| GB | 2441179 | A * | 2/2008 | E06B 7/10 |

OTHER PUBLICATIONS

U.S. Appl. No. 13/864,238, filed Apr. 16, 2013 titled "Laser Defense Gun Ports" by Baird.

(Continued)

*Primary Examiner* — Brent W Herring
(74) *Attorney, Agent, or Firm* — Barclay J. Tullis

(57) ABSTRACT

A blast and projectile resistant gun port is provided with both a roller-slide mechanism and a lever-actuated, spring-loaded, cam mechanism which a shooter operates to open or close a gun-port door over a gun-port opening in a gun-port frame, as well as to translate the gun-port door out of the way of the gun-port opening. The shooter is able to effect these actions by nudging the lever on the cam mechanism with or without placing one or more hands on the lever and is thus able to keep both hands on weaponry. The gun-port door keys into its closed position, and an elastic weather seal is squeezed firmly between the gun-port door and the gun port frame when the gun-port door is closed. The squeezing of the weather seal is effected by springs in the cam mechanism. The gun-port door and the components and subassemblies are easily and rapidly replaceable.

15 Claims, 6 Drawing Sheets

(56) References Cited

U.S. PATENT DOCUMENTS

| | | | | |
|---|---|---|---|---|
| 6,863,001 | B2 * | 3/2005 | Inage | 105/341 |
| 6,941,701 | B2 * | 9/2005 | Inage | 49/449 |
| 7,017,304 | B2 * | 3/2006 | Bourque et al. | 49/451 |
| 7,377,076 | B2 * | 5/2008 | Shedd | 49/449 |
| 7,611,190 | B1 * | 11/2009 | Elliott et al. | 296/155 |
| 7,849,633 | B2 * | 12/2010 | Oshima et al. | 49/209 |
| 8,438,783 | B2 * | 5/2013 | Giovannetti | 49/130 |
| 8,438,964 | B1 | 5/2013 | Nolte et al. | |
| 8,756,869 | B1 * | 6/2014 | Routt et al. | 52/20 |

OTHER PUBLICATIONS

U.S. Appl. No. 13/422,620, filed Mar. 16, 2012, titled "Gun Ports", by Roger Allen Nolte and Adam D. Baird.

* cited by examiner

HANDS-FREE GUN-PORT DOOR WITH SEAL

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention(s) relate(s) to gun ports useful in defense of armored vehicles and armored buildings, and in particular to gun ports with armored and blast-resistant doors that are weather sealed, and to gun ports with doors that both translate into and out of a closed position over a gun-port opening and roll out of the way of the gun-port opening along one or more guide rails.

2. Description of the Related Art

Gun ports are well known in the art for both military and non-military application. A gun port permits discharge of a fire arm or other weapon through an opening defined within the gun port whenever the gun port is in an open position. The gun port secures the port against passage of a bullet or other unwanted object whenever the gun port is in a closed position. Typically gun ports include a door as a closure shield secured on either an interior or exterior surface of a support apparatus such as an exterior wall of an armored vehicle or the exterior wall of a building. The door is often actuated by hand by an operator of the gun port standing or sitting next to an interior surface of the support apparatus, such as inside the armored vehicle or building. Examples of the prior art in gun ports are provided by U.S. Pat. Nos. 4,771,672; 4,771,673; and 6,425,311. In all three of these examples, the door consists of a single plate of metal. The first example discloses a door (or "closure plate") that is a single plate that is slid upward to open, and downward to close. The second example discloses a door (or "closure") that is a single plate that is pivoted inward and downward to open, and upward and outward to close. The third example discloses a door (or "closure shield") that is a single plate mounted on the outside of the exterior wall and that rotates parallel to the wall in a first rotational direction to open, and in the reverse direction to close.

The prior art does not disclose gun ports designed to withstand explosive blasts from military or terrorist threats. The prior art also does not disclose means to seal a gun-port door closure from leaking fluids such as rain water through the seams between the door and its port, and at the same time permit an operator carrying weaponry to quickly open and shut the gun-port door with a nudge of a forearm, upper arm, or heal or back of a hand. What are needed are gun ports that can withstand explosive blasts, and at the same time are constructed of preassembled subassemblies that enable easy installation and replacement, that seal tightly against water leaks, and that can be quickly and easily opened without requiring a firm hand grip on the door or door handle.

BRIEF SUMMARY OF THE INVENTION

A blast and projectile resistant gun port is provided with both a roller-slide mechanism and a lever-actuated, spring-loaded, cam mechanism which a shooter operates to open or close a gun-port door over a gun-port opening in a gun-port frame, as well as to translate the gun-port door out of the way of the gun-port opening. The shooter is able to effect these actions by nudging the lever on the cam mechanism with or without placing one or more hands on the lever and is thus able to keep both hands on weaponry. The gun-port door keys into its closed position, and an elastic weather seal is squeezed firmly between the gun-port door and the gun-port frame when the gun-port door is closed. The squeezing of the weather seal is effected by springs in the cam mechanism. The gun-port door and the components and subassemblies are easily and rapidly replaceable. Multiple plates comprising the door and its carrier on the roller slide mechanism are typically made of steel and provide effective armor against offending explosive blasts and/or ballistic projectiles.

The invention(s) is(are) pointed out in the following paragraphs which disclose example implementations and/or aspects.

A first implementation is a gun-port door apparatus that comprises a) a gun-port door and b) a mounting plate on which the gun-port door is mounted, and on which wheels or rollers are mounted to translate the mounting plate with the gun-port door along one or more guide rails into or out of position adjacent a gun-port opening in a gun-port frame, wherein the one or more guide rails are mounted to the gun-port frame. This first implementation may further comprise one or more extension arms from the gun-port door that extend movably through respective one or more holes in the mounting plate, wherein the door can be connected to a door-controlling device from the side of the mounting plate that is opposite to that of the gun-port door. This first implementation may further comprise a spring compression mechanism on the mounting plate, wherein the spring compression mechanism has one or more springs that push the gun-port door away from the mounting plate. The spring compression mechanism can be actuated to pull the gun-port door away from the gun-port opening and can be cam-actuated, wherein a cam pushes against the mounting plate. The extension arms can support the cam. The spring compression mechanism can include a lever that is connected to the cam. The lever can be used to push the gun-port door off of the gun-port opening, to push the gun-port against the gun-port opening, and/or to translate the gun-port door along the one or more guide rails. The gun-port door can include a registration plate that seats into the gun-port opening when the gun-port door is in a closed position. A sealing material can be located between the gun-port door and a region of surface on the gun-port frame around the gun-port opening when the gun-port door is in a closed position over the gun-port opening. The door location can be restrained by left and right end plates attached to the one or more guide rails. The gun-port frame can include at least one drip bar located above the gun-port opening.

A second implementation is a gun-port assembly comprising: a) a gun-port frame suitable for fitting into a wall to create a gun-port opening, b) a gun-port door suitable for covering the gun-port opening, and c) a gun-port door mount that can be translated along with the gun-port door to a position remote from the gun-port opening; wherein the gun-port door mount is mounted on wheels or rollers to be rolled along one or more co-parallel guide rails whose linear direction is parallel to the wall, and wherein the gun-port door mount includes a lever-actuated cam for moving both opening and closing the gun-port door and for translating the door along the one or more guide rails. This second implementation can further comprise an elastic sealing material where the gun-port door contacts the gun-port frame around the gun-port opening. The cam controls an amount of compression that is applied between the gun-port door and the gun-port door mount. The extension arms extending from the gun-port door extend through guiding holes in the gun-port mount and connect to the cam.

A third implementation is a method of operational manipulation of a gun-port door. This method comprises the steps of: a) opening or closing a gun-port opening by using a spring-loaded cam that is coupled to a gun-port door, and b) translating the gun-port door attached to a mounting plate that rolls along one or more guide rails, wherein the direction of travel can be chosen between left or right from alignment adjacent the gun-port opening. In some implementations of the method, both steps can be accomplished hands-free by nudging a lever that is connected to the cam. The method can further comprise a step of pressing an elastic sealant material located between the gun-port door and the gun-port frame.

One implementation of the invention(s) includes a gun port comprising a gun-port opening in a gun-port frame, wherein the gun-port frame is coupled to a movable, blast-resistant gun-port door. The door can be rolled or slid in either of two opposite directions along one or more guide rails (or slides or bars) away from a gun-port opening. The gun-port door comprises at least two spaced-apart plates, wherein the at least two spaced-apart plates can be made of steel. A lever attached to a cam that is pivotably attached to the gun-port door functions as a paddle or handle that can be nudged by a user's left or right arm or hand and used to open, close, and/or translate the door to one side or the other of the gun-port opening. The cam is spring loaded to control a stand-off distance of the gun-port door from the gun-port frame, and to effect pressure of the gun-port door against an elastic weather seal when the gun-port door is closed over the gun-port opening. The extent of the door's travel along the guide rails can be limited by left and right end caps.

OBJECTS AND ADVANTAGES OF THE INVENTION

Objects and advantages of the present invention(s) are numerous. One object and advantage is a port door that has been tested to withstand ballistic projectiles and explosive blasts from outside the port. The blast testing has shown that a gun port of the present invention(s) can reduce outside blast pressures of 25 psi outside down to pressures inside of less than 0.5 psi. This is accomplished by constructing a gun-port door that is close fitting against a port frame. It is also accomplished with a door that is constructed with not just one steel plate to close the opening of the port, but with a stack of two or more spaced-apart steel plates, wherein the steel can be A36 carbon steel rather than more exotic and expensive steels, and wherein the space between adjacent plates can simply be air space and spacer standoffs. In one such design, an outer plate of 1.5 inch (3.81 cm) thickness is spaced 1.625 inch (4.13 cm) from an inside plate of 1 inch (2.54 cm) thickness. A second object and advantage is a door handle that can be manually moved left or right to open a closed port with either hand of a shooter or other user, and more importantly hands-free with a shoulder, elbow, forearm, or the back of a hand or heal of a hand. A third object and advantage is a door that moves on rollers or slides, wherein the rollers or slides are protected by being located between the spaced apart plates of the door and a door mounting plate. Within this disclosure, "slide" can imply either sliding or rolling. A fourth object and advantage is a door sub-assembly, including movement guides, that can be removed and replaced easily from the inside or safe-side of its port frame.

The various features and further advantages of the present invention(s) and their preferred embodiments will become apparent to ones skilled in the art upon examination of the accompanying drawings and the following detailed description. It is intended that any additional advantages be incorporated herein. The contents of the following description and of the drawings are set forth as examples only and should not be understood to represent limitations upon the scope of the present invention(s).

BRIEF DESCRIPTION OF THE SEVERAL VIEWS OF THE DRAWINGS

The foregoing objects and advantages of the present invention(s) of gun ports may be more readily understood by one skilled in the art with reference being had to the following detailed description of several embodiments thereof, taken in conjunction with the accompanying drawings. Within these drawings, callouts using like reference numerals refer to like elements in the several figures (also called views) where doing so won't add confusion. Within these drawings.

DETAILED DESCRIPTION OF THE INVENTION

Figure 1:
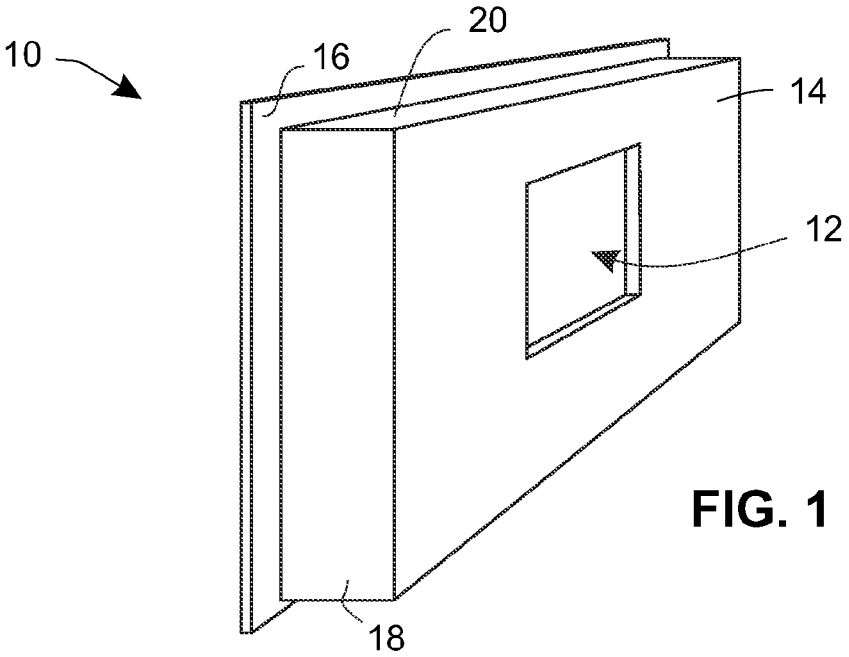
FIG. 1 shows a perspective view from the inside and left of a gun-port door frame.

The following is a detailed description of the invention(s) and its preferred embodiments as illustrated in the drawings. While the invention(s) will be described in connection with these drawings, there is no intent to limit it to the embodiment or embodiments disclosed. On the contrary, the intent is to cover all alternatives, modifications and equivalents included within the spirit and scope of the invention(s).

FIG. 1 shows a perspective view from the inside and left of a gun-port door frame 10 such as would be installed through a wall of a building or vehicle. A flange 16 on the gun-port door frame 10 is shown that would usually be located and referenced against the outside surface of the wall. A gun-port opening 12 is shown through which a weapon could be fired. The inside surface 14 of the gun-port frame would face the safe side of the gun-port opening 12. Shown also are a top surface 20 and a side surface 18 that would be inside the wall.

Figure 2:
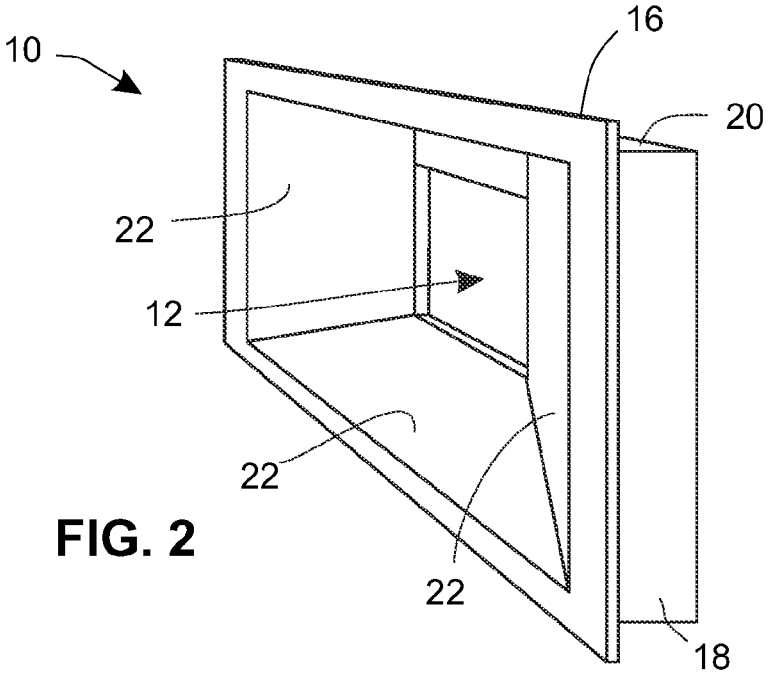
FIG. 2 shows a perspective view from the outside and right of a gun-port door frame.

FIG. 2 shows a perspective view from the outside and right of the gun-port door frame 10 of FIG. 1. Visible in this view are three sloped surfaces 22 which taper the gun port opening 12 to a larger size at the flange 16 than at the inside surface 14 (inside surface 14 is shown in FIG. 1).

Figure 3:
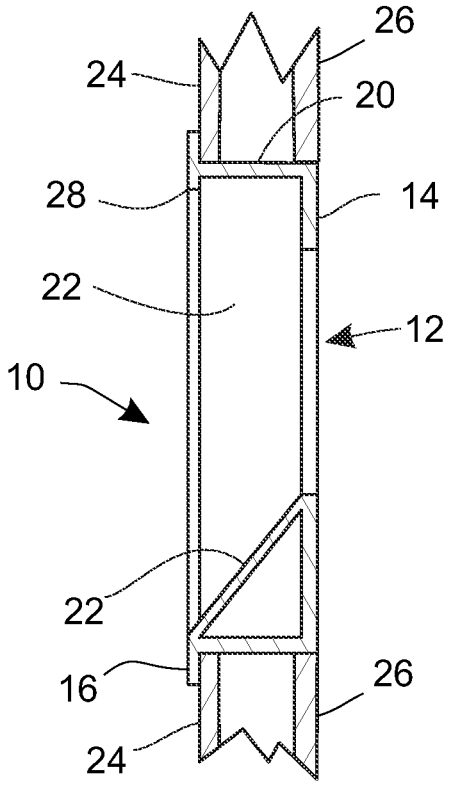
FIG. 3 shows a cross-sectional side-view of a gun-port door frame installed in a wall opening.

FIG. 3 shows a cross-sectional side-view of the gun-port door frame 10 installed in a wall opening that has been filled with the gun-port door frame 10. The wall is shown with its outside surface 24 and inside surface 26. The flange 16 is shown referencing against the outside surface 24 of the gun-port door frame 10. A drip edge 28 is shown at the bottom of the upper part of the flange 16, and there is no upper sloped surface to match the sloped surface 22 shown at the bottom of the gun-port opening 12, in order to prevent rain or other fluids that may impinge on the outside wall surface 24 from easily getting to the inside opening of the gun-port opening 12.

Figure 4:
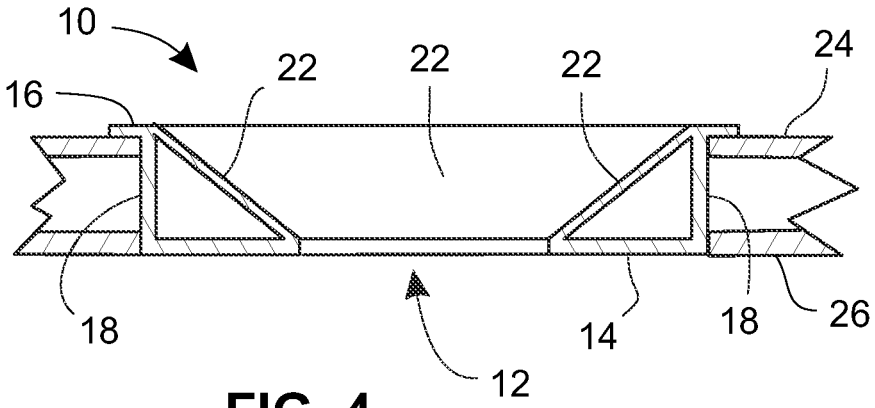
FIG. 4 shows a cross-sectional top-view of a gun-port door frame installed in a wall opening.

FIG. 4 shows a cross-sectional top-view of a gun-port door frame 10 installed in a wall opening that has been filled with the gun-port door frame 10. In this view, a sloped surface 22 is shown at each of the left and right of the gun-port opening 12. And, as in FIG. 3, the inside surface 26 and the outside surface 26 of the wall is shown.

Figure 5:
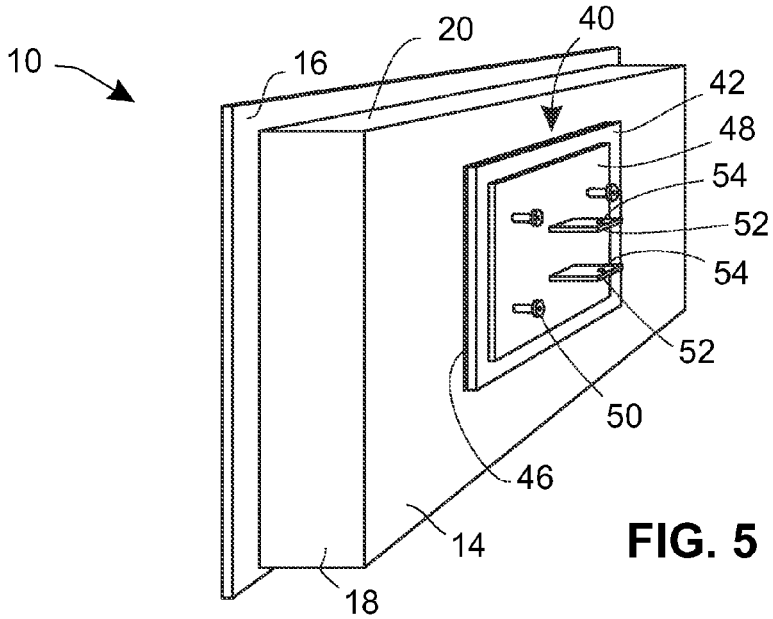
FIG. 5 shows a perspective view from the inside and left of a gun-port door frame with a gun-port door pressed against the gun-port door frame.

FIG. 5 shows a perspective view from the inside and left of a gun-port door frame 10 with a gun-port door sub-assembly 40 pressed against the insides surface 14 of the gun-port door frame 10. Comprising this gun-port door sub-assembly 40 are a main plate 42, a sealing element 46 around the perimeter of the main plate 42, and a backing plate 48 to which are removably attached four shoulder bolts 50 and two arm extensions 52 each with a pivot hole 54 for holding an axle with a pivotable cam 98 (the axle with cam 98 are visible in FIGS. 10-13). The four shoulder bolts 50, and the two extension arms 52, extend perpendicularly to the plane of the backing plate 48. The axes of the two pivot holes 54 are aligned co-axially with one another, and are generally oriented vertically and parallel with the surface 14.

Figure 6:
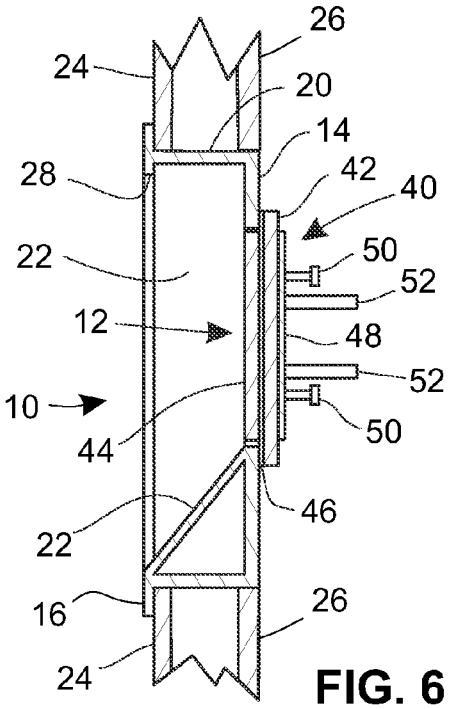
FIG. 6 shows a cross-sectional side view of a gun-port door pressed against a gun-port frame.

FIG. 6 shows a cross-sectional side view of a gun-port door sub-assembly 40 pressed with the sealant 46 against the inside surface 14 of a gun-port frame 10. The view of the gun-port frame 10 is the same as shown in FIG. 5, with the exception of the added gun-port door subassembly 40. What can be seen additionally in this view that isn't shown in FIG. 5 is a guide plate 44 that forms the front of the gun-port door sub-assembly 40. This guide plate 44 serves as both a) a skid plate that can rub against the surface 14 as the gun-port sub-assembly is translated parallel to that surface 14 when not closed over the gun-port opening 12, and b) as an alignment registration device to key the gun-port door sub-assembly 40 into the gun-port opening 12 as and when the gun-port door sub-assembly 40 is closed over the gun-port opening 12.

Figure 7:
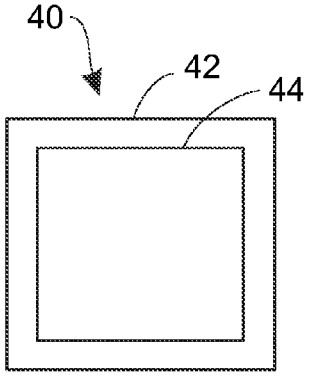
FIG. 7 shows a planar view of the outside-face of a gun-port door.

FIG. 7 shows a planar view of the outside-face of a gun-port door sub-assembly 40. The main plate 42 is shown to be larger than the guide plate 44. The width and height of the guide plate 44 are slightly smaller than the gun-port opening 12 to permit an easy fit of the former into and out of the latter. The surface of the main plate 42 that extends beyond the surface of the guide plate 44 is that surface area that would be covered by the sealing element 46 (not shown in this view, but called out in FIGS. 6, and 10-13).

Figure 8:
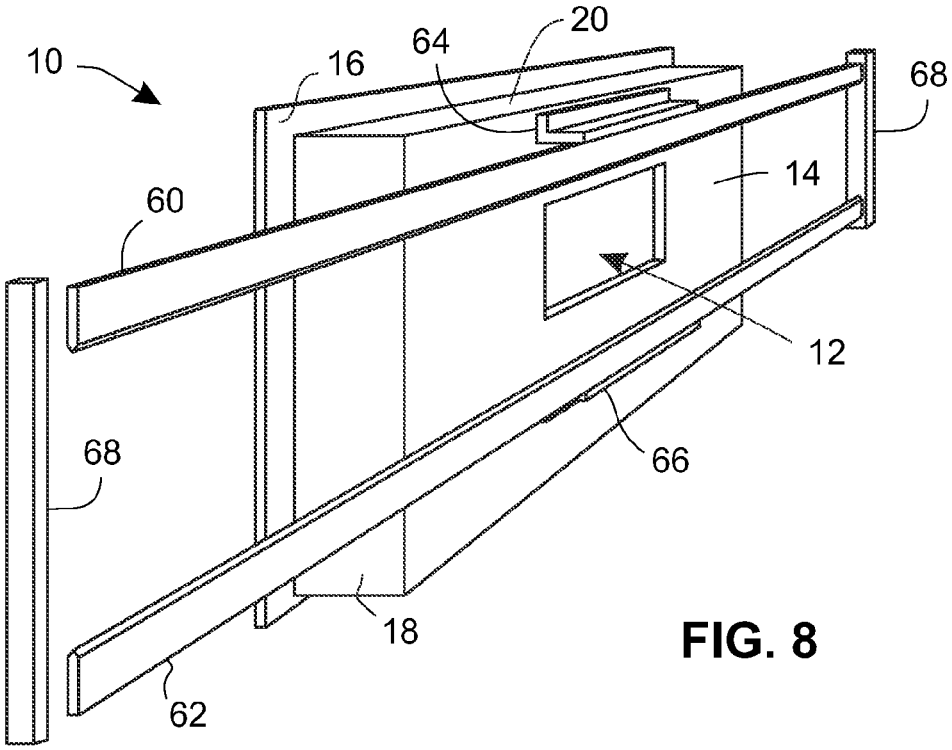
FIG. 8 shows a perspective view from the inside and left of a gun-port door frame with upper and lower roller tracks mounted to the frame by way of respective mounting brackets. The roller tracks are tied together at their left ends and at their right ends by respective end caps, however the left end cap is removed to permit visibility of the left end of the roller tracks.

FIG. 8 shows a perspective view from the inside and left of a gun-port door frame 10, as shown in FIG. 1, but with upper and lower roller tracks 60,62 mounted to the frame 10 by way of respective mounting brackets 64,66. The roller tracks 64,66 are tied together at their left ends and at their right ends by respective end caps 68, however the left end cap is removed to permit visibility of the left ends of the roller tracks 60,62.

Figure 9:
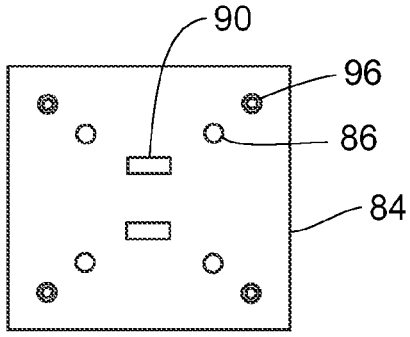
FIG. 9 shows a gun-port door mounting plate for translating and opening and closing the door.

FIG. 9 shows a gun-port door mounting plate 84 for supporting the gun-port sub-assembly 40 along the roller tracks 60,62 (shown in FIGS. 8 and 10-13), and for supporting the gun-port door sub-assembly 40 as it is opened from (or closed upon) the gun-port opening 12. This gun-port mounting plate includes a set of four outer-most holes 96 used to mount axles of rollers or wheels to engage the roller tracks 60,62 that serve as guide rails when this mounting plate 84 carries the gun-port door sub-assembly 40 to translate the gun-port door sub-assembly 40 parallel to the inside surface 14 of the gun-port frame 10 to move the gun-port door sub-assembly 40 out of the way of the gun-port opening 12. A next inner-set of four holes 86 are clearance holes for the shoulders of the four shoulder bolts 50 which are part of the gun-port door sub-assembly 40. The inner-most holes, i.e. the two rectangular holes 90, are clearance holes for the two door arms 52 first shown in FIGS. 5 and 6.

Figure 10:
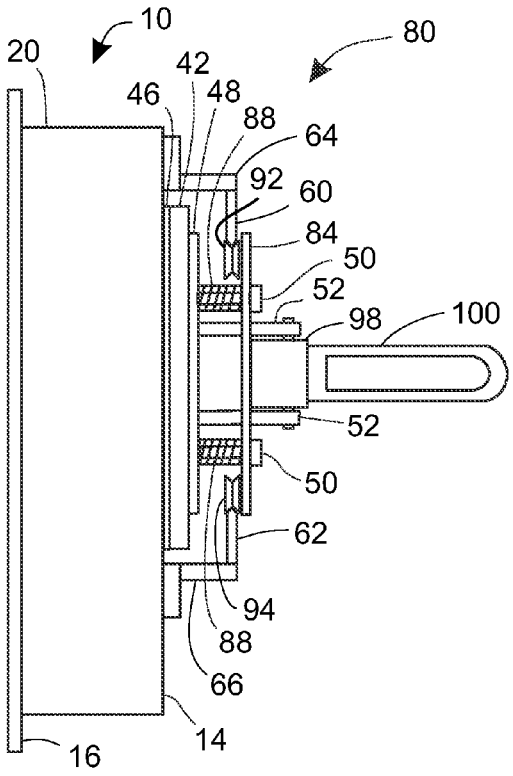
FIG. 10 shows a side view of a gun-port door with the door mounted to a gun-port door mounting plate that includes V-wheels/rollers to guide translation of the gun-port door along roller tracks that are supported by brackets to a port door frame. The gun-port door is shown in a shut position, and a wall into which the gun-port door frame would be mounted is not shown.
Figure 11:
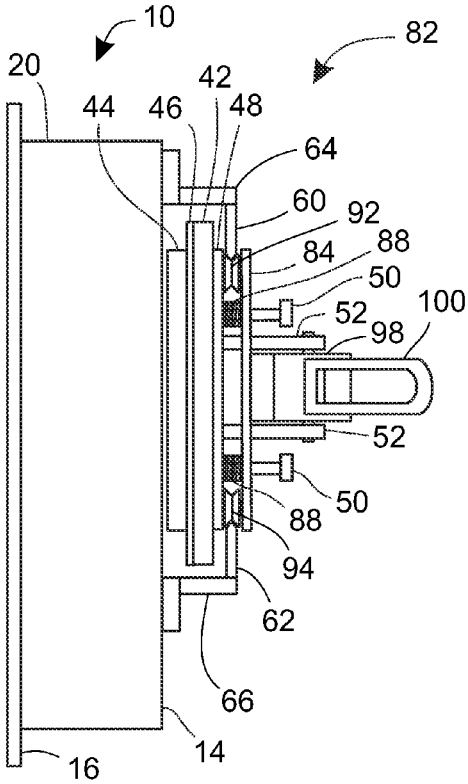
FIG. 11 shows a view similar to that of FIG. 10, but the door is shown in an open position.

FIGS. 10 and 11 show a side view of a gun-port door subassembly 40 mounted to a gun-port door mounting plate 84 that is in turn mounted with upper and lower pairs of V-wheels/rollers 92,94 to upper and lower roller tracks 60,62 that are in turn supported by upper and lower brackets 64,66 to a gun-port door frame 10. The gun-port door sub-assembly 40 is shown in a shut position 80 in FIG. 10, and in an open position 82 in FIG. 11. A wall into which the gun-port door frame would be mounted is not shown. Due to the complexity of the drawings in FIGS. 10 and 11, the callout ("40") for the gun-port door sub-assembly 40 is not shown, but is the same as shown and called out in FIGS. 5 and 6, with FIG. 6 presenting a cross-sectional view. Building on the illustrations in the previous figures, FIGS. 10 and 11 show in addition the rest of a complete implementation example. What is added in FIGS. 10 and 11 are compression springs 88 (retained in position by the previously introduced shoulder bolts 50, and compressed between the gun-port door sub-assembly 40 and the mounting plate 84), V-wheels 94 (supported by the mounting plate 84 and engaged on the roller tracks 60,62), and a cam and axle set 98 (supported by the door arms 52) and connected to a lever/handle/paddle 100 used to manipulate the cam (part of 98). Manipulation of the lever 100, and thereby of the cam (part of 98), effects a change in the amount of compression force applied to the springs 88 and allows their length to expand when shutting the door, and to shorten with opening the door.

Figure 12:
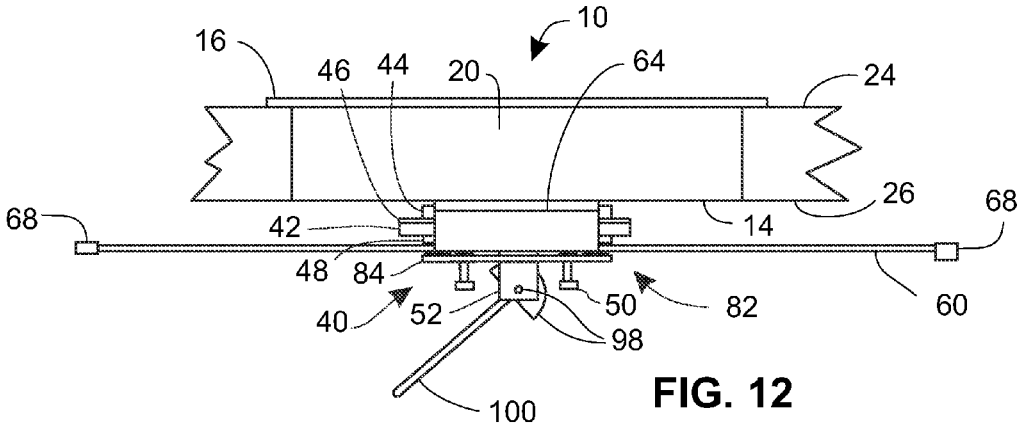
FIG. 12 shows a top view of what is shown in FIG. 11.
Figure 13:
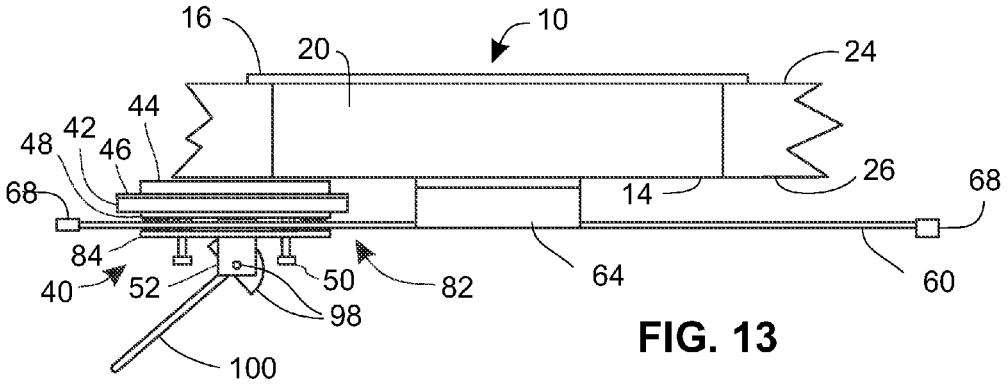
FIG. 13 shows a top view similar to FIG. 11. but where the door assembly has been translated to the left to uncover the gun-port opening in the gun-port door frame.

FIGS. 12 and 13 show a top view of what is shown in FIG. 11, wherein the gun-port door sub-assembly 40 is in an open position, however FIGS. 12 and 13 show the gun-port door sub-assembly and the other components mounted to the mounting plate 84 in each of two different locations along the roller tracks 60,62. In FIG. 12, the gun-port door sub-assembly is positioned over the gun port opening 12 at the centerline of the gun-port frame 10, but not shut tight onto the surface 14 of the gun-port frame 10. In FIG. 13, the gun-port door sub-assembly is positioned out of the way of the gun-port opening 12, i.e. toward one end (in this case the left end) of the roller tracks 60,62.

FIG. 13 shows a top view similar to FIG. 11. but where the door assembly has been translated to the left to uncover the gun-port opening in the gun-port door frame.

Embodiments of the invention include methods of opening, of closing, and of translating a gun-port door into position or out of the way with respect to a gun-port opening. One such method comprises the steps of: a) opening or closing a gun-port opening by using a spring-loaded cam that is coupled to a gun-port door, and b) translating the gun-port door attached to a mounting plate that rolls along one or more guide rails, wherein the direction of travel can be chosen between left or right from alignment adjacent the gun-port opening. In some implementations of the method, both steps can be accomplished hands-free by nudging a lever that is connected to the cam. This method can further comprise a step of pressing an elastic sealant material located between the gun-port door and the gun-port frame.

Several embodiments are specifically illustrated and/or described herein. However, it will be appreciated that modifications and variations are covered by the above teachings and within the scope of the disclosure without departing from the spirit and intended scope thereof. Method steps described herein may be performed in alternative orders. The examples provided herein are exemplary and are not meant to be exclusive.

Although specific embodiments of the invention have been illustrated and described herein, those of ordinary skill in the art will appreciate that any arrangement configured to achieve the same purpose may be substituted for the specific embodiments shown. One such substitution would include the addition of electro-mechanical actuation and actuators to move the gun-port door in response to a nudge or gesture by an operator or shooter. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to those of skill in the art upon reviewing the above description. The scope of various embodiments of the invention includes any other applications in which the above structures and methods are used.

I claim:

1. A gun-port assembly comprising:

a. a gun-port frame supporting one or more guide rails and comprising a gun-port opening;

b. a gun-port door suitable for covering a planar area of the gun-port opening; and c. a door mount assembled to the gun-port frame and the gun-port door and that can be translated along with the gun-port door along at least one of the one or more guide rails to a position away from the gun-port opening;

wherein the gun-port door and the door mount are held apart by one or more compression springs that are each permanently aligned with a longitudinal axis perpendicular to the planar area;

wherein at least two extension arms extending from the gun-port door extend through respective guiding holes in the door mount and connect to a spring-loaded cam; and wherein the spring-loaded cam controls distance separating the gun-port door from the door mount.

2. The gun port assembly of claim 1, wherein the spring-loaded cam controls an amount of compression that is applied between the gun-port door and the door mount.

3. The gun-port door apparatus of claim 1, further comprising:

a spring compression mechanism connected to the door and the door mount, wherein the spring compression mechanism has one or more springs that push against the gun-port door in a direction away from the door mount.

4. The gun-port door apparatus of claim 3, wherein the spring compression mechanism can be actuated to move the gun-port door away from the gun-port opening.

5. The gun-port door apparatus of claim 3, wherein the spring compression mechanism is actuated by the cam, and wherein the cam pushes against the door mount.

6. The gun port assembly of claim 1;

wherein the cam and a lever extending from the cam rotate about a common axis;

wherein an axle for the cam and lever is mounted to the extension arms, and the cam presses against the door mount;

wherein the gun-port door is opened or closed by action of the cam.

7. The gun-port door apparatus of claim 6, wherein manipulations of the lever can push the gun-port door off of the gun-port opening, push the gun-port against the gun-port opening, and translate the gun-port door along the one or more guide rails.

8. The gun port assembly of claim 6;

wherein the door can be opened or closed by the force of a user's arm pushing on the lever.

9. The gun-port door apparatus of claim 6;

wherein the door is connected by way of the extension arms to the axle that is on an opposite side of the door mount from the door.

10. The gun-port door apparatus of claim 6, wherein the axis is directed at least approximately upward.

11. The gun-port door apparatus of claim 1, wherein the gun-port door includes a registration plate that seats into the gun-port opening when the gun-port door is in a closed position.

12. The gun-port door apparatus of claim 1, wherein a sealing material is located between the gun-port door and a region of surface bordering the gun-port opening when the gun-port door is in a closed position over the gun-port opening.

13. The gun-port door apparatus of claim 1, wherein the door location is restrained by left and right end plates attached to the one or more guide rails.

14. The gun-port door apparatus of claim 1, wherein at least one drip bar is located above the gun-port opening.

15. The gun-port door apparatus of claim 1, wherein the door mount is mounted on at least one selected from the group consisting of a wheel, a roller, and a slidable surface.

* * * * *